United States Patent [19]

Summer

[11] Patent Number: 5,025,518

[45] **Date of Patent: * Jun. 25, 1991**

[54] ORTHOPEDIC HEAD PILLOW

[76] Inventor: John D. Summer, 1427 NW. 23rd Ave., Portland, Oreg. 97210-2615

[ * ] Notice: The portion of the term of this patent subsequent to Sep. 6, 2005 has been disclaimed.

[21] Appl. No.: 404,229

[22] Filed: Sep. 6, 1989

Related U.S. Application Data

[63] Continuation-in-part of Ser. No. 271,107, Nov. 4, 1988, Pat. No. 4,768,246.

[51] Int. Cl.[5] ..... A47C 20/02

[52] U.S. Cl. ..... 5/434; 5/436; 5/437

[58] Field of Search ..... 5/434, 436, 437, 442

[56] References Cited

U.S. PATENT DOCUMENTS

| | | | |
|---|---|---|---|
| D. 256,728 | 9/1980 | Allen | 5/434 |
| D. 261,681 | 3/1981 | Chandler | 5/436 |
| 2,700,779 | 9/1952 | Tolkowsky . | |
| 2,940,087 | 2/1957 | Kiefer . | |
| 2,940,088 | 2/1959 | Boos . | |
| 3,118,512 | 1/1964 | Talley, Jr. . | |
| 3,139,631 | 7/1964 | Kiefer . | |
| 3,276,046 | 10/1966 | Capelli | 5/436 |
| 3,400,413 | 9/1968 | La Grossa . | |
| 3,602,928 | 9/1971 | Helzer | 5/436 |
| 3,694,831 | 10/1972 | Treace . | |
| 3,753,264 | 8/1973 | Grenier . | |
| 3,829,917 | 8/1974 | De Laittre | 5/436 |
| 3,848,281 | 11/1974 | Mathews . | |
| 3,981,032 | 9/1976 | Brooks . | |
| 3,987,507 | 10/1976 | Hall . | |
| 4,017,118 | 4/1977 | Cawley . | |
| 4,259,757 | 4/1981 | Watson . | |
| 4,375,112 | 3/1983 | Leonhart . | |
| 4,424,599 | 1/1984 | Hannouche | 5/434 |
| 4,494,261 | 6/1985 | Morrow | 5/434 |
| 4,617,691 | 10/1986 | Monti et al. . | |
| 4,768,246 | 9/1988 | Summer | 5/434 |
| 4,803,743 | 2/1989 | Greenawalt | 5/434 |

FOREIGN PATENT DOCUMENTS

| | | | |
|---|---|---|---|
| 8101524 | 11/1981 | Fed. Rep. of Germany | 5/436 |
| 2305956 | 4/1975 | France | 5/434 |

*Primary Examiner*—Eric K. Nicholson

*Attorney, Agent, or Firm*—Klarquist, Sparkman, Campbell, Leigh & Whinston

[57] ABSTRACT

An orthopedic pillow in accordance with the present invention comprises a unitary body of feathers, foam or other resilient material with a deep generally hemispherical depression or aperture. The aperture receives the back of a user's head in such a manner that a portion of the weight of the head is supported generally on or substantially close to a mattress or the like beneath the pillow while the rest of the weight of the user's head is supported by the surrounding portion of the pillow. This design allows the user's head to rest generally on the same horizontal surface on which the remainder of the user's body rests. As a result, the head can shift backwardly into an ideal postural position in relation to the long axis of the user's body. Also, the aperture is eccentrically positioned in the body to provide different distances between the edge of the body and the aperture. Preferably, the pillow is rectangular with the aperture offset from the axes of the pillow. By orienting the pillow appropriately, it can be positioned to fit users with different neck lengths.

13 Claims, 1 Drawing Sheet

ORTHOPEDIC HEAD PILLOW

CROSS REFERENCE TO RELATED APPLICATION

This is a continuation-in-part of patent application Ser. No. 07/271,107 filed Nov. 4, 1988 and entitled Orthopedic Head Pillow now U.S. Pat. No. 4,768,246.

BACKGROUND OF THE INVENTION

1. Field of the Invention

The present invention relates to orthopedic pillows and more particularly to pillows designed to treat the common problem of forward head posture. The design of the present invention is based on the principle that the health of the spinal system is enhanced by sleeping on our backs with our heads in a fully retruded position in relation to the long axis of our bodies, as if no pillow is used.

2. Description of the Prior Art

In our culture people typically place something soft under their heads while sleeping in order to spread out the weight of the head and thereby provide comfort and reduce the ischemia which results when the weight of the head is concentrated on a small surface area. Yet, when a person sleeps on his or her back, cushions placed directly under the head prop the head up so that it rests on a horizontal plane which is higher (farther from the ground) than the plane on which the body rests (usually the mattress). This arrangement may be comfortable because no ischemia is produced locally on tissues, yet it may contribute to the postural strain in the spine which has become almost endemic in our society.

It is widely agreed that the conditions producing back pain and chronic discomfort take an enormous toll on our society in terms of man-hours lost from work and symptomatic medical treatment aimed at providing temporary relief. It is also widely agreed that the body posture during sleep in important in both etiology and treatment for this condition. Thus, it is not surprising that an orthopedically designed alternative to the traditional pillow has become necessary.

As we have studied the postural systems of those suffering from back pain, an almost constant finding has been forward head posture. A vertical axis through the head rests farther in front of a vertical axis through the body than is found in healthy subjects. As the head is shifted forward the forward facing convex curve of the neck beneath it (called the cervical lordosis) is lost. Forward head posture while standing forces the entire spine to strain in order to balance the head on its top section. This is because the spinal column must align its weight bearing surfaces directly underneath the head in order to effectively provide vertical support. Forward head posture results immediately in increased resting electrical activity (or tonus) in the muscles of the back. This arises because, as the head shifts forward, it drags the shoulder girdle with it, and the muscles running up and down the back of the spine are forced to operate at longer resting lengths as their attachments shift slightly further away from each other. Frequently these muscles have a difficult time adapting, especially when blood flow to the area is already compromised by strain or injury. These muscles are required to hold the heavy head out in front of them rather than directly over the spinal column which is designed to accept forces directed straight dow on it. Thus, a head which is postured back over the shoulders and spinal column is preferred to a head postured forward over a person's sternum.

Traditional pillows add to the problem of forward head posture. This happens because, while the user is lying on his or her back, they prop the head vertically above the surface of the mattress. As a result the head is maintained in a forward position relative to the long axis of the body.

One known alternative is the contoured pillow designed to anatomically mirror the healthy cervical column. These pillows feature a convexity positioned in the middle of the back of the neck and which is designed to reestablish the lordosis which should be there. Yet it is the positioning of the top of the cervical column too far forward, not the positioning of the middle of the cervical column too far back, which causes the orthopedic problem in the first place. The contoured pillow does not address this problem as it still props the head forward off the mattress. Furthermore, the body's need to keep its airway open will prevent any lordosis from occurring by the cervical spine moving forward into the space normally reserved for air passage.

Another know alternative to the traditional head pillow has been the cervical pillow. Such a pillow also attempts to push a lordosis into the back of the cervical column. This may become unbearable if it threatens to impinge on a person's airway, but it has the important advantage of allowing the head to rest all the way back on the same plane as the rest of the body. Thus, orthopedically such pillows may be helpful. However, the trouble with cervical pillows is that they are not comfortable because they do not support the head in a way which distributes its weight widely to prevent ischemia beneath weight bearing surface areas of the head. The weight of the head rests only on the occipital (rear) section of the skull and the upper cervical column (which is particularly ill suited for bearing weight because of the extensive venous drainage in the area).

Other alternative pillows have been designed for use by a person sleeping on his or her side. Such pillows provide a therapeutic postural position of the head by placing the proper thickness of material between the side of the head and the mattress. However, many specialists in the field of spinal orthopedics agree that sleeping on the back is healthier than sleeping on the side, and sleeping on the stomach is the worst of all.

The ideal head posture during sleeping is therefore achieved when no pillow at all is used and the head is allowed to shift backward until its occipital portion rests on the mattress. This allows the head to retrude in relation to the long axis of the spine and thereby produces, at least while sleeping, a correct head posture rather than a forward head posture. The only problem commonly encountered when no pillow is used under the head is that the entire weight of the head rests on a small area of the back of the head. As a result, this area may become ischemic and uncomfortable due to the typical pressure of nine to fourteen pounds resting on it. The point of a pillow is to cushion the head so that it can rest comfortably.

Therefore, a need exists for an improved orthopedic pillow directed towards overcoming these and other problems of the prior art.

SUMMARY OF THE INVENTION

Accordingly, it is one object of the present invention to provide an improved orthopedic head pillow which will encourage the user to sleep on his or her back with the occipital area of the head generally in contact with the same surface on which the other bony areas of the user's body (i.e., back, shoulders, hips, etc.) rest, thus promoting improved head posture and its attendant health benefits.

Another object of the invention is to provide such a pillow which supports the head by evenly distributing its weight widely about the entire occipital portion of the skull, avoiding excessive contact pressure in any one area so as to maximize comfort and satisfactory blood flow to all areas of the head.

Still another object of the present invention is to provide such a pillow which is capable of fitting users with necks of various lengths.

A further object of the present invention is to provide a pillow which is comfortable and which can be manufactured in a cost effective manner.

In furtherance of these and other objects of the present invention, an improved orthopedic pillow is described with a body of a resilient material, such as encased feathers or other stuffing material or a self-skinning polyurethane foam. The pillow has an upper surface and a base surface which rests on a mattress or other support surface for a user of the pillow. The pillow body has a peripheral edge or boundary and an interior wall surface which defines a generally hemispherical head receiving aperture or depression spaced from the peripheral edge. The aperture permits the back of the user's head to rest substantially in the plane of the mattress or other support surface. Also, the wall surface bounding the aperture supports the sides of the user's head so as to distribute the weight of the head and cushion the head during use. Such a pillow allows the head to be positioned in a fully retruded position in relation to the long axis of the body so as to orthopedically treat the problem of forward head posture.

As another feature of the invention, the aperture is eccentrically positioned at a location within the body so as to provide differing distances from locations along the peripheral edge of the pillow to the aperture. That is, the center of the aperture is displaced from the center of the body. By appropriately rotating or orienting the pillow, a user can select the distance between the peripheral edge and aperture which more closely conforms to the length of the user's neck. The body may take a variety of shapes including circular or ellipical, but is preferably rectangular with its length longer than its width. In addition, the body may have a trapezoidal-shaped vertical cross section with the aperture being generally an inverted trapezoid in a vertical cross section.

These and other features, objects and advantages of the present invention will become apparent with reference to the following description and drawings.

DETAILED DESCRIPTION OF THE PREFERRED EMBODIMENTS

Figure 1:
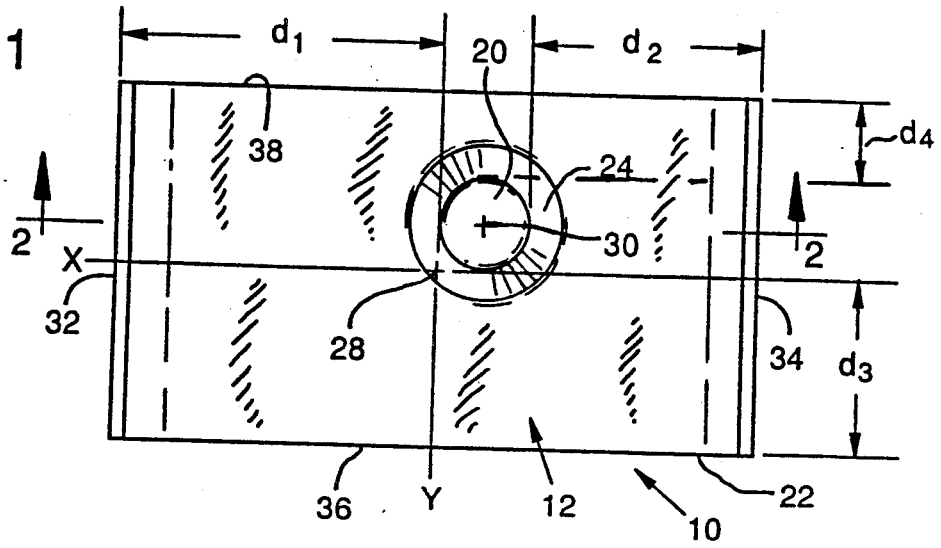
FIG. 1 a top plan view of an improved orthopedic pillow in accordance with the present invention.
Figure 2:
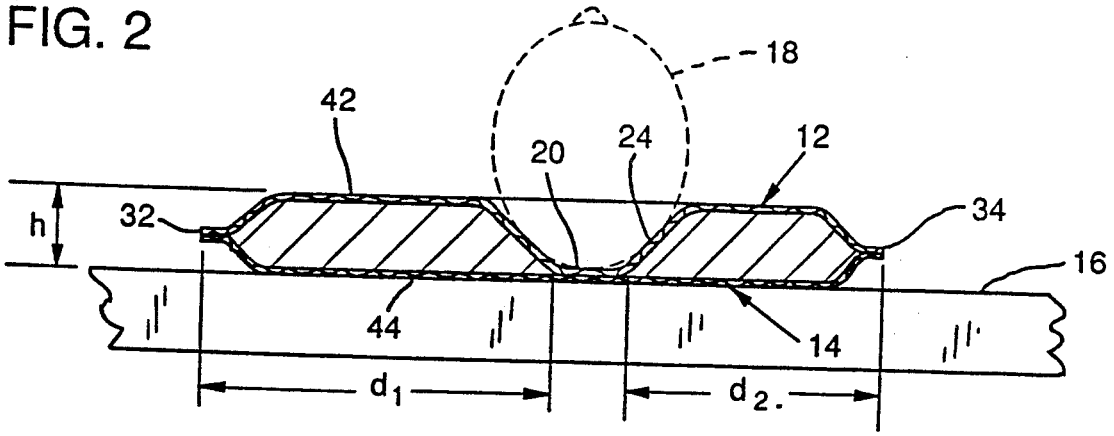
FIG. 2 is a cross sectional view of the pillow of FIG. 1, taken along lines 2—2 thereof, which shows a person in dashed lines lying on a mattress and using the pillow.

Referring to FIGS. 1 and 2, one form of improved orthopedic pillow in accordance with the present invention includes a body 10 with an upper surface 12 and a lower or base surface 14. Base surface 14 is typically generally planar for resting on the upper surface of a mattress or other support 16, as shown in FIG. 2. As shown in this figure, the base surface 14 is also generally in the same plane as the bottom of the occipital region of a user's head 18 and the other bony regions (such as the shoulder, back and hips) of the user when lying on his or her back on the mattress. Top permit this positioning of the user's head, an aperture or depression 20 extends between the upper surface 12 and the base surface 14. This aperture is spaced from the peripheral edge 22 of the body. In addition, the aperture is bounded by an interior wall 24 such that the aperture 20 is generally hemispherical in shape.

In the FIG. 1 for of the invention, the body 10 is generally an elongated rectangular form with a center as indicated at 28. The aperture 20 is generally circular in horizontal section, but has its center 30 spaced from the center 28 of the body. That is, the pillow 10 has X and Y axes which are orthogonal and intersect at the center 28 of the pillow 10. The X axis in this figure is the longitudinal axis of the pillow and the Y axis is the transverse axis of the pillow. The X and Y axes in this case thus divide the pillow into four substantially equally sized quadrants. The aperture center 30 is displaced from center 28 and in this form of pillow is preferably offset from each of the X and Y axes. Moreover, in the illustrated embodiment the entire base of the aperture 20 is positioned in one quadrant, in this case the upper right-hand quadrant of pillow 10. In an alternative embodiment, the aperture center is displaced along only one of the axes from the center, such as along the Y axis. This eccentric or off-centered positioning of the aperture enables the pillow to comfortably be used by individuals with necks of varying lengths. That is, by merely rotating the pillow, a user can orient the pillow so as to comfortably support the user's neck, whether the user has a short or long neck. Also, if the center of the aperture is only offset from the X axis along the Y axis, the pillow is typically rotated through 180 degrees about a Z axis to present a different length neck supporting portion to a user.

More specifically, with the orientation shown in FIG. 1, the pillow is designed to provide a distance d1 from the left-hand boundary of the aperture 20 in the X-direction to a peripheral edge section 32 of the pillow; a distance $d_2$ from the right-hand boundary of the aperture 20 in the X-direction to a peripheral edge section 34 of the pillow; a distance $d_3$ from the lower boundary of the aperture 20 in the Y-direction to a lower peripheral edge section 36 of the pillow; and a distance $d_4$ from the upper boundary of the aperture 20 in the Y-direction to an upper peripheral edge section 38 of the pillow.

The actual size of the pillow may vary; however, one typically size is 16 inches wide by 24 inches long. In this specific example, a two-inch diameter generally circular aperture may be used and the respective distances $d_1$, $d_2$, $d_3$ and $d_4$ may be respectively 12 inches, 10 inches, 8 inches and 6 inches. Because all of these distances are different, as a user rotates the pillow through a 90 degree movement, the pillow can be oriented to closely fit a user's neck. As another specific example, a pillow may be 18 inches wide by 26 inches long. In this case a three-inch diameter generally circular opening is used. The center of this opening is on the Y axis, but is offset from the X axis to establish distances $d_3$ and $d_4$ of respectively 8½ and 6½ inches. In this case the pillow is rotated 180 degrees to more closely fit a user's neck.

As shown in FIG. 2, the pillow 10 may be formed of upper and lower covering sections 42, 44, which are sewn or otherwise fastened together at their peripheral edges and stuffed with a suitable resilient material 45, such as, for example, feathers or foam pieces. To maintain the aperture when feathers, foam pieces or other particulate stuffing is used, the cover sections 42, 44 are typically stitched, adhesively secured, or otherwise fastened together at the desired locations (i.e., location 20) to define the depression. By fastening the cover sections to define the depression, the stuffing is restrained from passing into the area of the depression. The covering sections may be of any suitable material such as natural or synthetic fabric. In general, pillow 10 may be made available in size which fit commercially available pillowcases.

Figure 3:
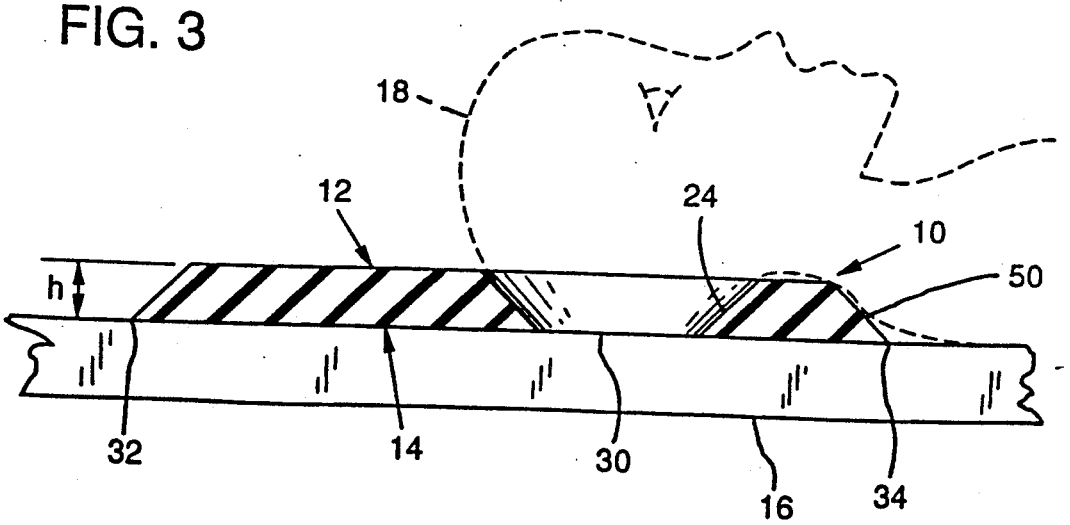
FIG. 3 cross sectional view of another form of a pillow in accordance with the present invention, and also showing a person in dashed lines using the pillow.

For added comfort, as shown in FIG. 3, the outer surface 50 of the body 10 can be tapered or bevelled outwardly moving from the upper surface 12 toward the lower surface 14. In other words, the dimension of the pillow from center 28 is smallest adjacent the upper surface 12 and largest adjacent the lower surface 14. This tapered periphery 32; although not required, provides added comfort because it more closely fits the contour of a user's lower neck and upper shoulder region.

Also, as can be best seen in FIG. 3, in vertical cross section this illustrated form of pillow is generally trapezoidal in shape. In addition, as also shown in this figure, the aperture 20 of this form of pillow can be described as having an inverted trapezoidal vertical cross section. Moreover, upper surface 12 is generally parallel to and spaced from the lower surface 14. The height of the pillow "h", see FIGS. 2 and 3, is preferably within the range of one to two inches and more specifically from one and three-eights to one and three-fourths inches. A pillow which is much higher than this would tend to raise the head out of its fully retruded position in relation to the long axis of the body. In contrast, a pillow that is much shorter than this would concentrate the weight of the user's head over a small area, resulting in potential discomfort to the user.

A pillow in accordance with the present invention may be cut from a block or piece of synthetic foam material, as shown in FIG. 3, utilizing a jig. In this case, no assembly or molding would be required. Alternatively, a pillow of the desired configuration and shape may be molded in a conventional manner using a self-skinning polyurethane material. In addition, as shown in FIG. 1, a pillow in accordance with the present invention can be covered with a casing without changing the essential character or functioning of the aperture. That is, the thin layers of cloth or material that would cover the aperture in this case would not significantly interfere with the orthopedic benefits available from a pillow in accordance with the present invention. Likewise, if the aperture is in the form of a depression that does not pass through to surface 14, the pillow still functions so long as the back of the user's head is not elevated significantly above the mattress surface. Typically, it is desired to have the head flush with or no more than within approximately one-fourth inch of the plane containing the mattress, and thereby substantially in the plane of the supporting mattress surface.

Having illustrated and described the principles of my invention with reference to several preferred embodiments, it should be apparent to those persons skilled in the art that such invention may be modified in arrangement and detail without departing from such principles. I claim as my invention all such modifications as come within the true spirit and scope of the following claims.

I claim:

1. An orthopedic head pillow for supporting a user's head while the user is supported by a mattress or other support surface comprising:

a body of resilient material;

the body having a upper surface and a base surface for resting on the support surface;

the body having a peripheral edge or boundary and an interior wall surface defining a head receiving aperture spaced from the peripheral edge, the aperture permitting the back of the user's head to rest flush with or within no more than approximately one-fourth inch of the plane of the support surface with the wall surfaces supporting the sides of the user's head when the user is lying on the support surface and the user's head is positioned within the aperture;

the aperture being positioned at a location within the body so as to provide differing distances from plural locations in orthogonal directions along the peripheral edge to the aperture, whereby a user may orient the pillow to select the distance between the peripheral edge and aperture which conforms to the length of the user's neck; and the body having a generally elongated rectangular periphery with a center; and the aperture having a center which is displaced from the center of the body.

2. An orthopedic pillow according to claim 1 in which the upper and base surfaces are generally planar and the body is tapered outwardly from the upper surface to the base surface at the periphery.

3. An orthopedic pillow according to claim 1 in which the distance between the upper and base surface is in the range of from one inch to two inches.

4. An orthopedic pillow according to claim 1 in which the distance between the upper and base surfaces is in the range of from one and three-eights inches to one and three-fourths inches.

5. An orthopedic head pillow according to claim 1 in which the body has first and second intersecting orthogonal axes which intersect and subdivide the body into four substantially equal quadrants, and in which the aperture has a lower base portion which is entirely in one quadrant.

6. An orthopedic head pillow for supporting a user's head while the user is supported by a mattress or other support surface comprising:

a body of a resilient material having a center;

the body having an upper surface and a base surface for resting on the support surface;

the boyd having a peripheral edge or boundary and an interior walls surface defining a generally hemispherical head receiving aperture spaced from the peripheral edge, the aperture permitting the back of the user's head to rest flush with or within no more than approximately one-fourth inch of the plane of the support surface with the wall surfaces supporting the sides of the user's head when the user is lying on the support surface and the user's head is positioned within the aperture;

the aperture having a center which is displaced from the center of the body, whereby a user may orient the pillow in any of four orthogonal orientations, each orientation providing a unique distance between the peripheral edge and aperture which conforms to the length of the user's neck.

7. An orthopedic head pillow according to claim 6 in which the pillow has a first longitudinal axis and a second transverse axis normal to the first axis, the center of the aperture being offset from the first axis.

8. An orthopedic head pillow according to claim 7 in which the center of the aperture is offset from both the first and second axes.

9. An orthopedic pillow according to claim 6 in which the upper and base surfaces are each distinct, generally flat planes and the body is tapered outwardly from the upper surface to the base surface at the periphery.

10. An orthopedic pillow according to claim 6 in which the distance between the upper and base surfaces is in the range from one inch to two inches.

11. An orthopedic pillow according to claim 6 in which the distance between the upper and lower base surfaces is in the range from one and three-eighths inches to one and three-forth inches.

12. An orthopedic head pillow according to claim 6 in which the body has first and second intersecting orthogonal axes which intersect and subdivide the body into four substantially equal quadrants, and in which the aperture has a base portion which is entirely in one quadrant.

13. An orthopedic head pillow according to claim 1 in which the body has first and second intersecting orthogonal medial axes which intersect generally the center of the body, and in which the center of the aperture is displaced from the first and second axes.

* * * * *